United States Patent [19]

Pinto

[11] 3,978,773

[45] Sept. 7, 1976

[54] PACKAGE LINER FORMING AND FEEDING APPARATUS

[76] Inventor: Albert Anthony Pinto, 6 Willows Lane, White Plains, N.Y. 10605

[22] Filed: Nov. 29, 1974

[21] Appl. No.: 528,424

[52] U.S. Cl. ..... 93/37 SP; 53/157; 93/49 R; 93/53 SD

[51] Int. Cl.[2] ..... B31B 1/04; B31D 3/04

[58] Field of Search ..... 93/37 SP, 37 R, 37 EC, 93/36.01, 53 R, 53 SD, 49 R; 53/156, 157, 159

[56] References Cited

UNITED STATES PATENTS

| | | | |
|---|---|---|---|
| 2,623,442 | 12/1952 | Thaxton | 93/37 R |
| 2,709,399 | 5/1955 | Smith | 93/73 SP |
| 3,162,099 | 12/1964 | Currie et al. | 93/53 SD X |
| 3,797,197 | 3/1974 | Fluck | 53/156 |

*Primary Examiner*—James F. Coan

[57] ABSTRACT

The liners are formed from flat corrugated paper sheets that are stored on edge in a magazine. A vacuum picker transfers single sheets to a conveyor and they are creased on the upper surface by disc blades. The creased sheets are fed between narrow upper and lower conveyor belts and drawn through plow elements which fold the sheets to form liners. The formed liners are carried by gripping heads of an overhead chain conveyor to a constantly moving bucket conveyor. The axis of the chain conveyor is set at an acute angle to the axis of the bucket conveyor and the gripping heads are rotated by cam elements to align the liners with the conveyor buckets.

3 Claims, 30 Drawing Figures

TO PACKAGING

FROM FIG. 6
TO FIG. 22
TO FIG. 23

FROM FIG. 11.
22
24
25
26
27
29
30
31
10
115
125
135
136
137
140
141
142
155
156
157
176
177
181
182
185
2-2
2-3
2-4
2-5
2-6

FROM FIG12
10
15
16
24
25
26
27
29
104
107
134
135
140
146
151
155
177
180
181
182
184
185

PACKAGE LINER FORMING AND FEEDING APPARATUS

BACKGROUND OF THE INVENTION

The present invention relates to the packaging of stacked articles, and, more particularly, to apparatus for forming and feeding package liners used to holding stacks of articles in position within a container, such as a plastic bag.

It is common to package cookies and crackers within flexible plastic bags by folding a corrugated paper sheet to form a liner, stacking the articles in rows on the liner, and sliding this assembly into the bag. The liners normally are folded to provide a pair of parallel walls extending at right angles from a base section between the walls, and a pair of base sections outwardly of the walls. Such a liner accommodates three columns of articles, one between the walls, and one on the outer side of each wall. Each of the columns are formed by stacking the articles on edge on the three base sections of the liner.

In the past, the liners were folded manually and were manually placed into buckets where the columns of articles are stacked on the liner base sections. These manual operations limited the production rate of the product and accounted for a disproportionate part of the cost of the product.

SUMMARY OF THE INVENTION

It is an object therefore to provide apparatus for automatically forming package liners.

Another object is to provide such apparatus for automatically feeding the formed liners into the buckets of a continuously moving bucket conveyor for loading.

Another object is to provide such apparatus for feeding the liners into the buckets of an inclined continuously moving bucket conveyor.

Another object is to provide such apparatus wherein the liners are moved and oriented so as to match the motion and orientation of the conveyor buckets while conveying the liners to the buckets.

The foregoing objects are accomplished by providing apparatus comprising in combination a magazine for holding flat sheets of liner material, means for transferring the sheets to a conveyor, means for creasing the sheets to form fold lines, means for folding the sheet along the fold lines to form the liner, and an overhead conveyor carrying a plurality of heads spaced along the length thereof for gripping the liners and carrying the liners to a bucket conveyor.

BRIEF DESCRIPTION OF THE DRAWINGS

A preferred embodiment of the invention has been chosen for the purposes of illustration and description, and is shown in the accompanying drawings, forming a part of the specification, wherein.

Figures 1, 2, 3, 4:
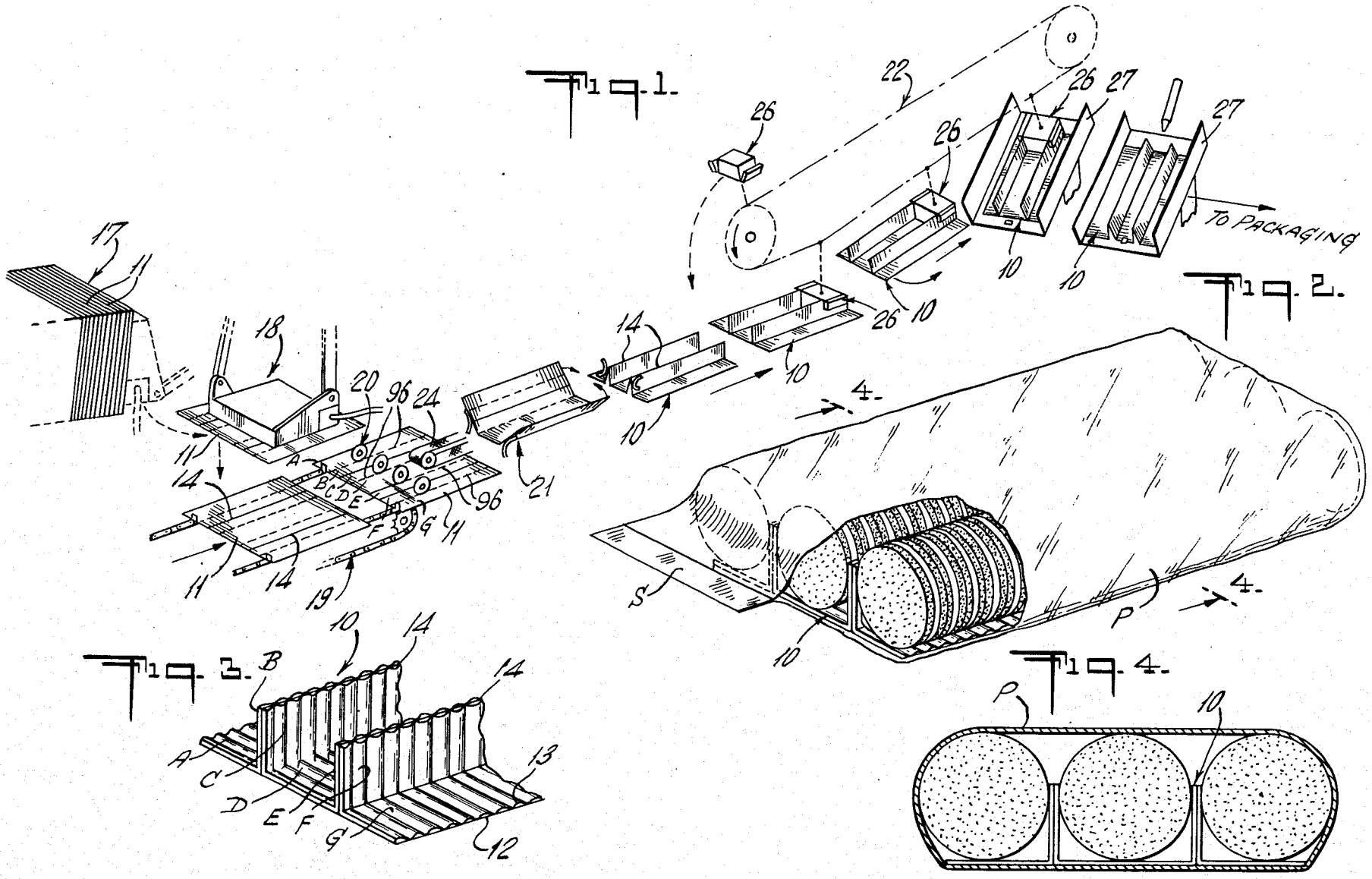
FIG. 1 is a view schematically illustrating portions of a machine according to the present invention and showing the condition of the liner at various stages as it is formed from a flat sheet.
FIG. 2 is an isometric view of a package of cookies utilizing the liner formed by the machine.
FIG. 3 is a fragmentary isometric view of a formed liner.
FIG. 4 is a sectional view taken along the line 4—4 on FIG. 2.

Referring now to the drawings in detail, there is shown apparatus according to the present invention for forming a corrugated paper package liner 10 (FIGS. 1–4), and depositing the liner in an inclined bucket conveyor to be filled with articles, such as cookies or the like, and packaged as shown in FIGS. 2 and 4.

Figure 10:
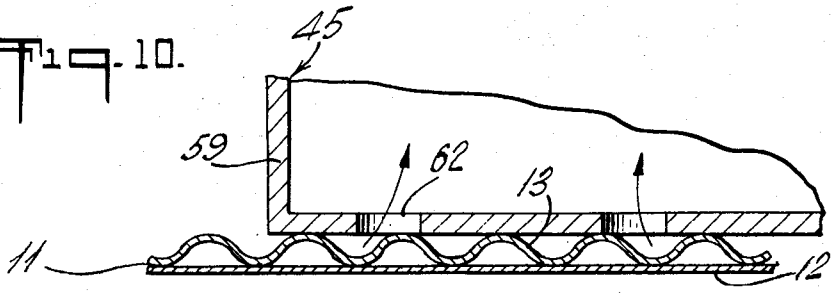
FIG. 10 is sectional view taken along line 10—10 on FIG. 7.

As shown in FIGS. 1 and 10, the liners 10 are formed from rectangular two ply paper sheets 11 which comprise a flat base layer 12 and a corrugated upper layer 13. The upper layer is precut along two parallel lines 14 to permit 180 degree folding.

The apparatus includes side frames 15 and 16 which support a magazine 17, a vacuum picker 18, a chain conveyor 19, a creasing mechanism 20, a folding mechanism 21, and a chain conveyor 22.

Referring now to FIGS. 1, 6, 11 and 22, the sheets 10 are stored on edge in the magazine 17. The vacuum picker 18 removes single sheets from the magazine and places them on the chain conveyor 19. The sheets are fed by the conveyor 19 to the creasing mechanism 20.

The creased sheets are drawn through the folding mechanism 21 by a pair of narrow conveyor belts 24 and 25 to form the liners. The formed liners are picked up by gripping heads 26 of the chain conveyor 22 and are moved into the buckets 27 of a bucket conveyor 29.

Figure 5:
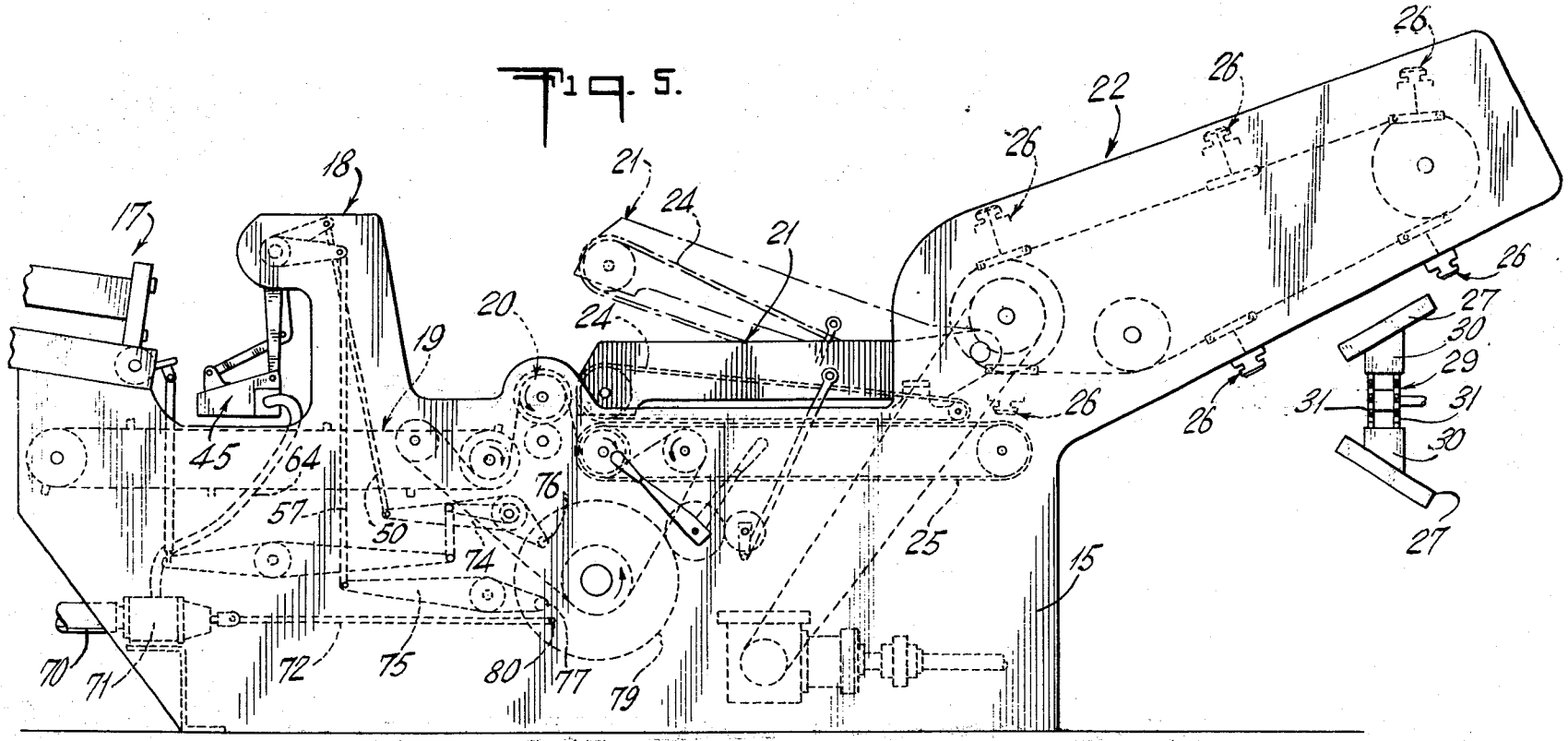
FIG. 5 is a side elevational view of the machine according to the present invention.
Figure 22:
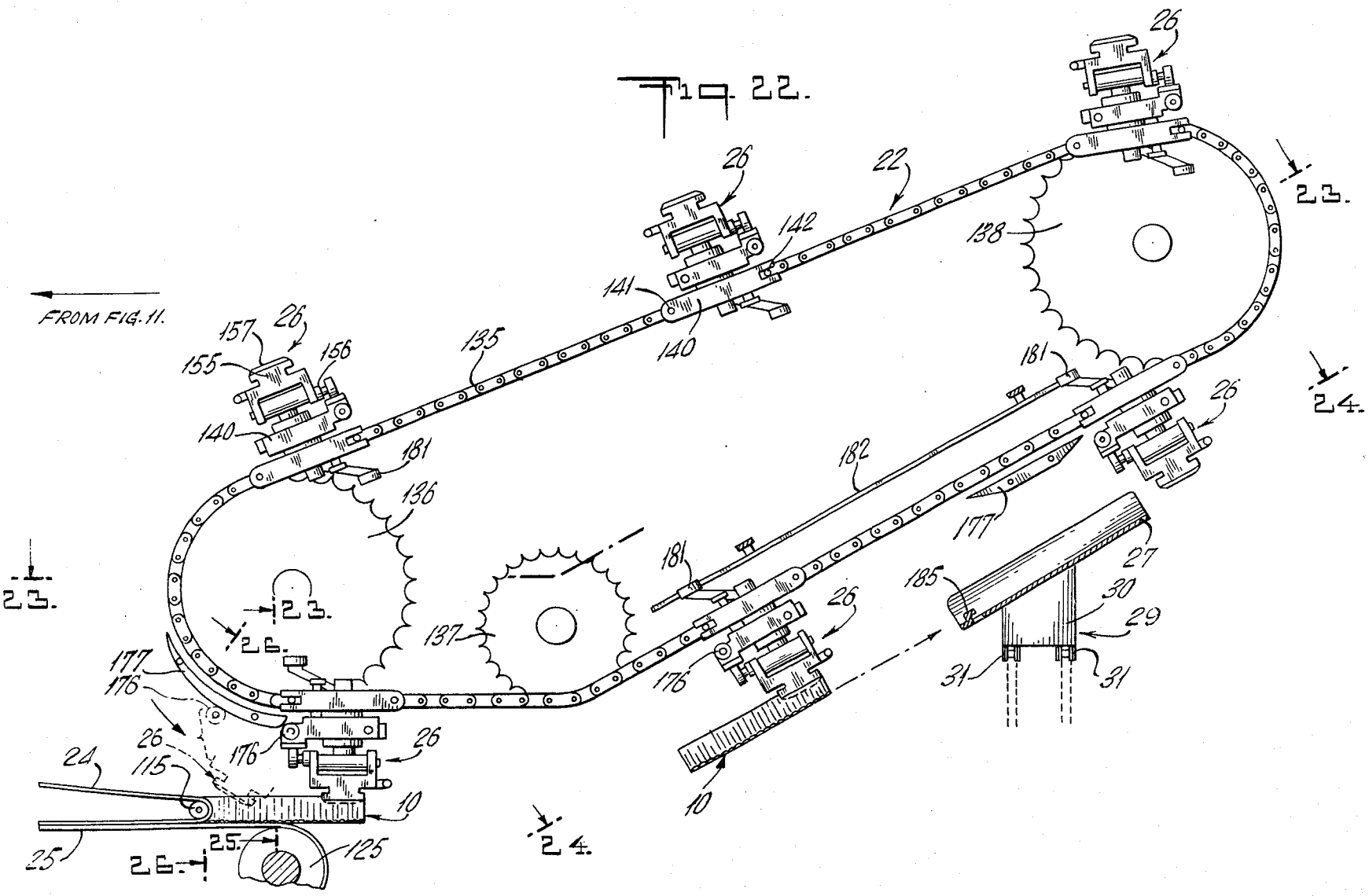
FIG. 22 is a sectional view of the rear end portion of the machine, taken inside the side frame to expose the chain conveyor.
Figures 23, 24:
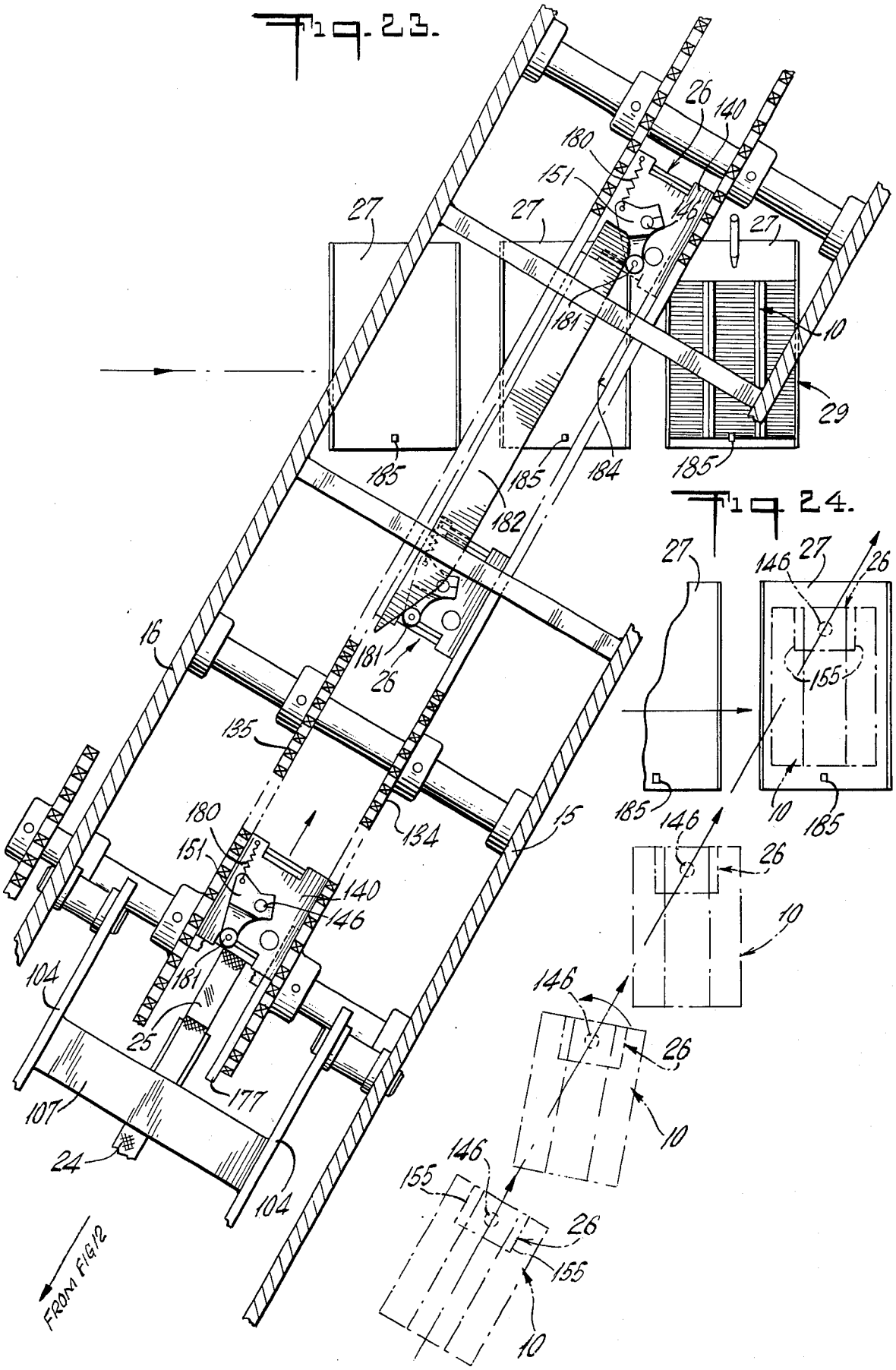
FIG. 23 is a top view of the portion of the machine shown in FIG. 22.
FIG. 24 is a schematic top view showing the changing orientation of the liner as it is transported by the chain conveyor shown in FIG. 23.

As shown in FIG. 23, the longitudinal axis of the apparatus is set at an angle of about 60 degrees to the longitudinal axis of the bucket conveyor 29. As shown in FIGS. 5 and 22 the buckets 27 are mounted on base members 30 which are secured to a pair of conveyor chains 31. The base members 30 are formed to incline the buckets with respect to the horizontal.

Figures 6, 7, 8, 9:
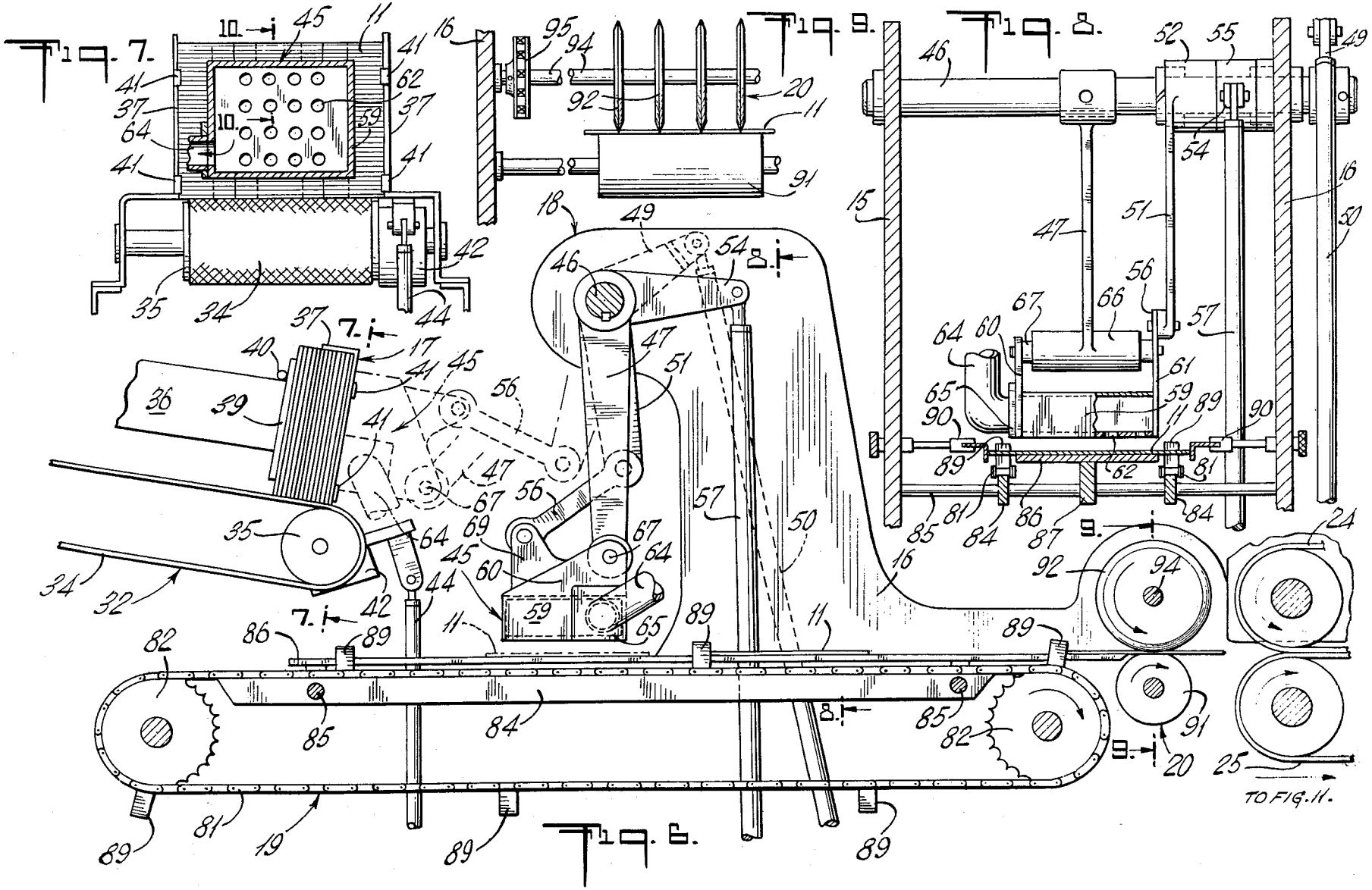
FIG. 6 is a side elevational sectional view of the front end portion of the machine, taken inside the side frame to expose a number of the mechanisms contained therein.
FIG. 7 is a view taken along line 7—7 on FIG. 6 showing the magazine construction.
FIG. 8 is a view taken along line 8—8 on FIG. 6 showing the construction of the vacuum picker mechanism.
FIG. 9 is a view taken along line 9—9 on FIG. 6 showing the construction of the creasing mechanism.
Figures 11, 12:
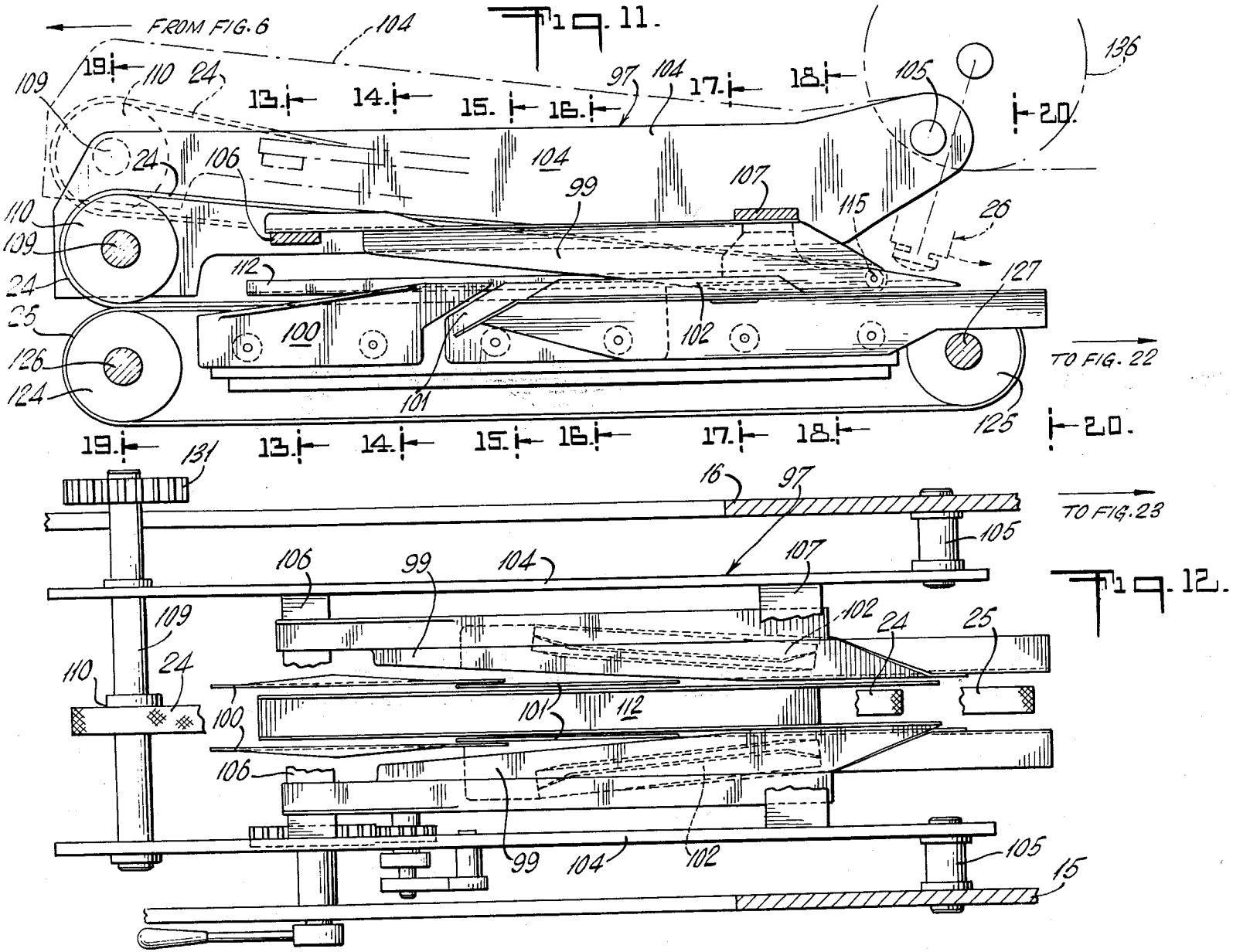
FIG. 11 is a sectional view of the central portion of the machine, taken inside the side frame to expose the folding mechanism thereof.
FIG. 12 is a top plan view of the portion of the machine shown in FIG. 11, FIGS. 13 to 18 are sectional views taken along the lines 13—13 to 18—18 respectively on FIG. 11 and showing details of the folding mechanism.

The magazine 17, as shown in FIGS. 6 and 7, includes a conveyor 32 including a belt 34 and a roller 35, a pair of side guide plates 36 extending above the conveyor, a pair of bars 37 extending vertically over the roller 35 and supporting on end of the plates 36, and a plate 39 having a rod 40 secured thereto and resting on the top edges of the plates 36 to slideably support the plate 39 on the plates 36. Four tabs 41 extend inwardly from the bars 37 to retain the sheets 11 in the magazine. A ratchet mechanism 42, mounted on the roller 35 and operated by a rod 44, rotates the roller to advance the conveyor belt each time a sheet is removed by the picker 18.

The vacuum picker 18 includes a vacuum head 45, a shaft 46 journalled in the side frame plates 15 and 16, an arm 47 keyed to the shaft and supporting the head 45, an arm 49 keyed to the shaft, a rod 50 for operating the arm to rotate the shaft 46, an arm 51 having a hub 52 pivotally mounted on the shaft 46, an arm 54 having a hub 55 pivotally mounted on the shaft and locked to the hub 52, a link 56 connecting the arm 51 to the head 45 and a rod 57 coupled to the arm 54.

The head 45 comprises a box 59 formed with side plates 60 and 61 and having a perforated surface 62. A flexible vacuum line 64 is connected to a coupling 65 secured to the side plate 60. The arm 47 is provided with an elongated hub 66 which is rotatably mounted on a shaft 67 extending between the side plates 61 and 62. The plate 62 is formed with a protrusion 69 on the forward end thereof to which the link 56 is pivotally attached.

As shown in FIG. 5, the vacuum line 64 is connected to a main vacuum line 70 through a valve 71 which is operated by a rod 72. The rods 50 and 57 are connected to one end of levers 74 and 75 respectively. Cam followers 76 and 77 respectively are positioned on the other ends of the levers 74, 75 and engage cam tracks on a cam wheel 79. The rod 72 also carries a cam follower 80 which engages a cam track on the wheel 79.

In each revolution of the cam wheel 79, the rod 50 is pulled downwardly, swinging the head 45 toward the magazine 17. At the same time, the rod 57 is pulled downwardly a lesser distance so that the head is rotated about the shaft 67 to bring the surface 62 against the end sheet 11 in the magazine. The valve 71 is then opened by movement of the rod 72 to introduce vacuum to the head 45. The motion of the rods 50 and 57 is then reversed and the head moves back to the position shown in FIG. 5, carrying a sheet 11. The valve 71 is operated to vent the interior of the box 59 and the sheet drops onto the conveyor 19.

The chain conveyor 19 includes a pair of endless chains 81 each extending between a pair of spaced sprockets 82. Beneath the upper flight of each chain, a supporting bar 84 is mounted on a pair of rods 85 extending between the frame plates 15 and 16. A platform 86, positioned between the upper chain flights, is mounted on a bar 87 which is also supported by the rods 85. The vacuum picker 18 deposits the sheets upon the platform 86. Pusher fingers 89 are mounted to the chains 81 at regular intervals to move the sheets 11 along the platform 86. Centering guides 90 extend from the frame plates 15 and 16 to align the sheets 11 with the creasing mechanism 20.

As shown in FIGS. 6 and 9, the creasing mechanism 20 includes a freely rotatable roller 91 and four disc blades 92 mounted on a shaft 94 driven by a chain driven sprocket wheel 95. The blades 92 crease the sheets 11 along lines 96 as shown in FIG. 1. The cut lines 14 and the crease lines 96 divide the sheet 11 into seven panels A to G as shown in FIG. 1 and FIGS. 13 to 18.

Figure 19:
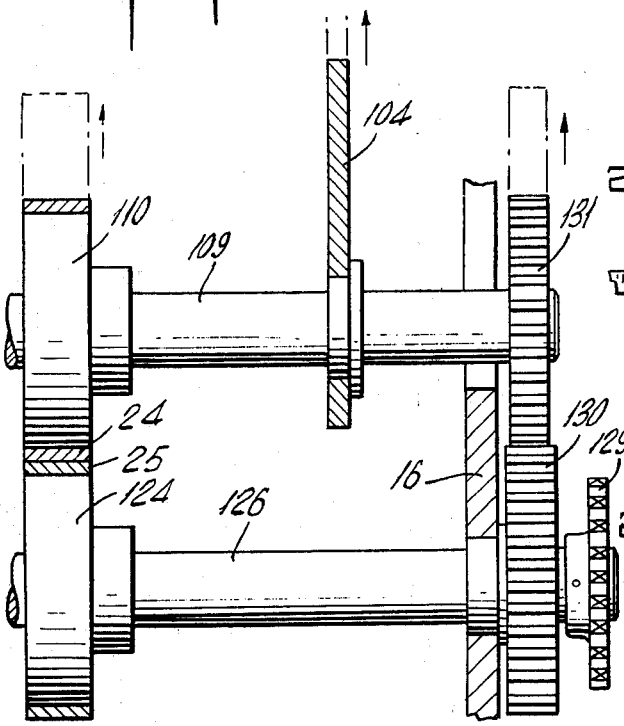
FIGS. 19 and 20 are partial sectional views taken along lines 19—19 and 20—20 respectively on FIG. 11.
Figure 20:
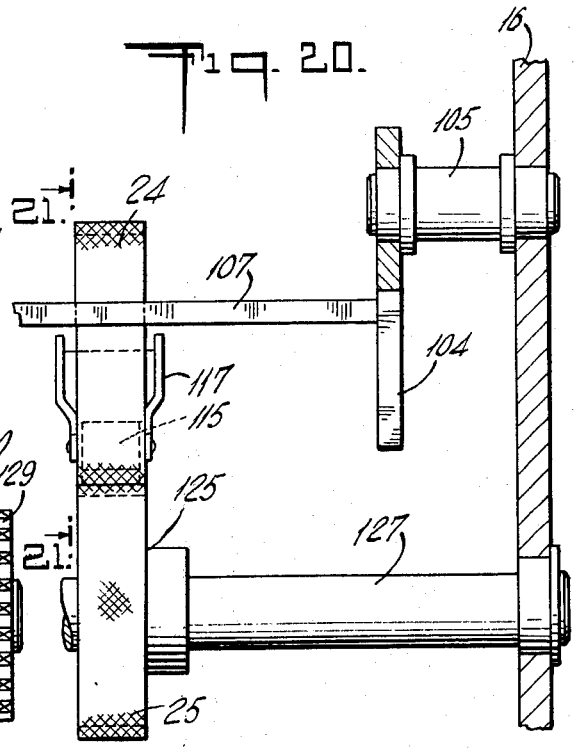
Figure 21:
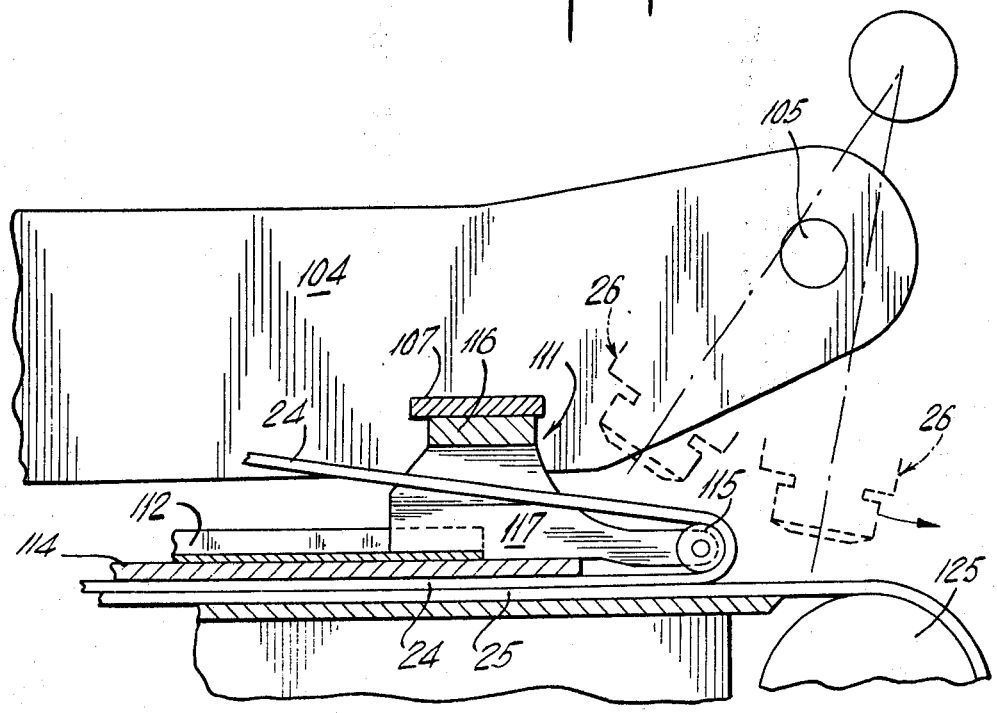
FIG. 21 is an enlarged sectional view of a portion of FIG. 11 taken along the centerline of the machine.

Upon leaving the mechanism 20, the sheets are fed between the conveyor belts 24 and 25 of the folding mechanism 21. As shown in FIGS. 11–21, the folding mechanism 21 includes a pivoted assembly 97 carrying the upper conveyor belt 24, a pair of upper plow elements 99 carried by the assembly 97, and three pair of lower plow elements 100–102 mounted on either side of the lower conveyor belt 25. The assembly 97 includes a pair of plates 104 pivoted upon shafts 105 which are journalled in the frame plates 15 and 16 and a pair of bars 106 and 107 extending between the plates 104. The plow elements 99 are mounted on the bars 106 and 107. A shaft 109 is journalled in the plates 104 and carries a conveyor roller 110. A bracket 111 (FIG. 21) is mounted to the lower surface of the bar 107 and carries a channel member 112, a narrow plate 114 and a conveyor roller 115. The conveyor belt 24 is mounted on the rollers 110 and 115 and runs along the lower surface of the narrow plate 114. The bracket 111 comprises a base 116 welded to the bottom surface of the bar 107, and a pair of side members 117 extending into the channel member 112. The plow element 100–102 are mounted on a bar 119. The elements 100 and 101 are secured to opposite sides of the bar 119 by means of cylindrical spacers 120. The elements 100 are vertically oriented plates having outwardly turned upper edges which slope upwardly along the length of the elements. The elements 101 are vertical plates with upper edges of uniform height. A pair of angle members 121 are also secured to the bar 119 for mounting the plow elements 102. The elements 102 consist of elongated angle shaped members which are fastened to the members 121 at a converging angle with respect to the conveyor belts 24 and 25. A narrow plate 122 is secured to the upper edge of the bar 119 to support the conveyor belt 25 which extends between a pair of rollers 124 and 125. The rollers 124 and 125 are mounted on shafts 126 and 127 journalled in the frame plate 15 and 16. As shown in FIG. 19, the shaft 126 is driven through a sprocket wheel 129. A gear 130 is mounted on the shaft 126 and engages a gear 131 mounted on the shaft 109 of the upper conveyor to drive the belt 24 when the pivoted assembly is in its lower position. The plow element carring bar 119 is supported by a plate 132 extending from the frame plate 16.

Figures 13, 14, 15, 16, 17, 18:
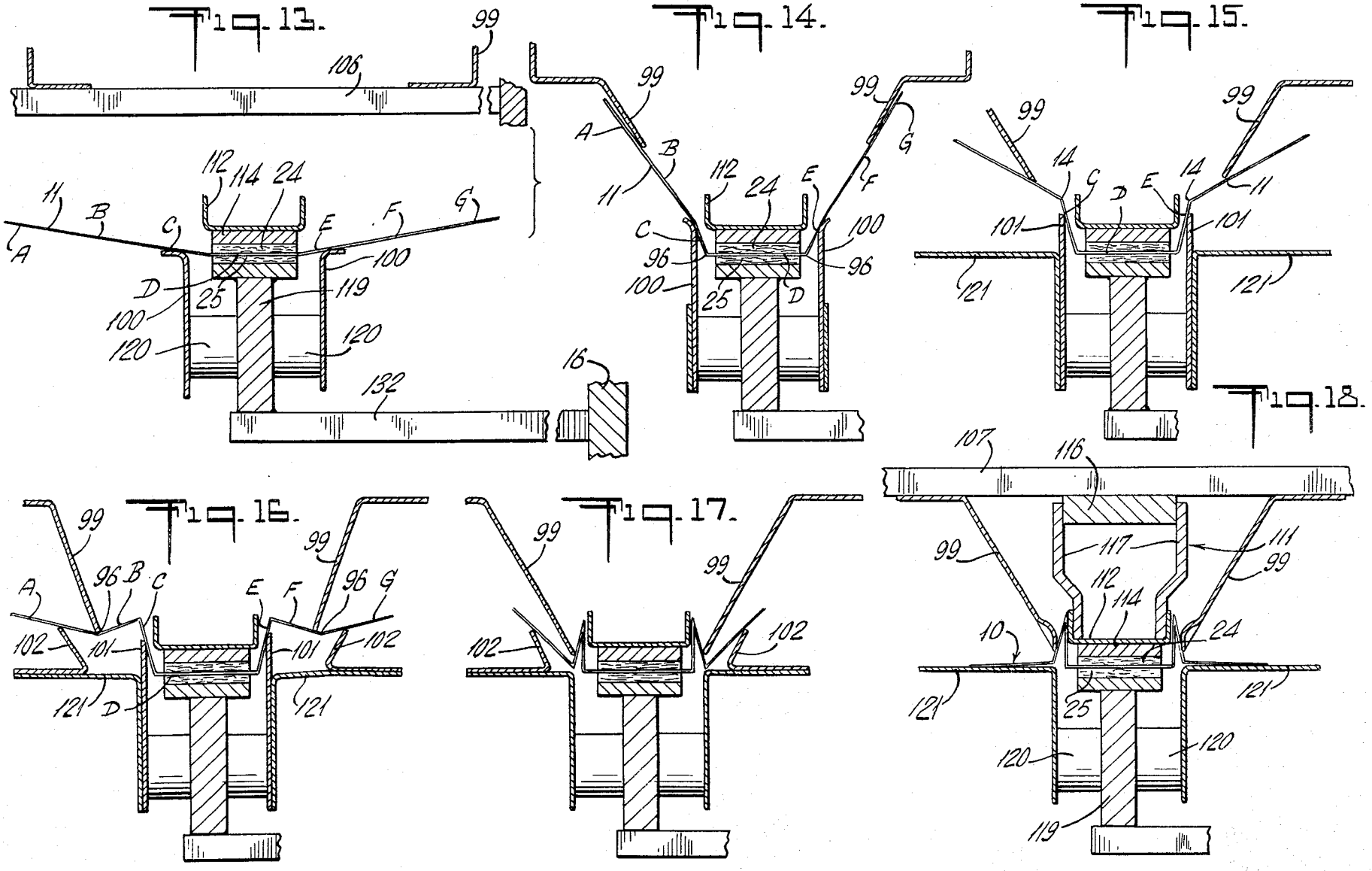

The sheet 11 is drawn through the folding mechanism between the conveyor belts 24 and 25. As the sheet moves past the plow elements 100, these elements engage the panels C and E and fold upwardly along the inner crease lines 96 on each side of the panel D, as shown in FIGS. 13 and 14. The elements 101 then hold the sheet in the folded configuration while the elements 99 engage the panels B and F and fold the sheet downwardly along the cut lines 14 (FIG. 15) and bring the panels A and G into engagement with the elements 102 (FIG. 16). The elements 99 and 102 cooperate as shown in FIGS. 16 and 17 to fold the edges of the sheet 11 upwardly along the outer crease lines 96 to produce a fully formed liner 10 as shown in FIG. 18 and in FIG. 3.

In the event a defective sheet 11 becomes caught in and jams the folding mechanism 21, the upper conveyor assembly 97 is rotated upwardly upon the shafts 105 to provide access to the interior of the mechanism to remove the jammed sheets. As the assembly 97 is raised, the gear 131 moves away from the gear 130 to stop the conveyor belt 24 and facilitate removal of the jammed sheets.

Figure 30:
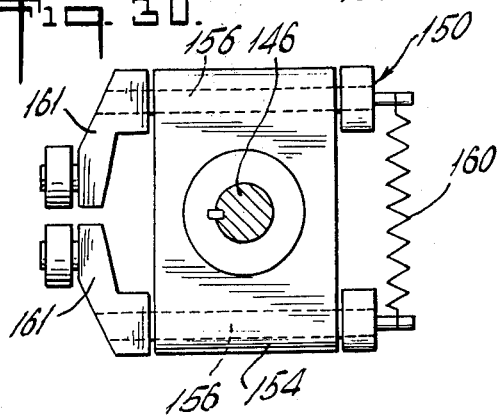
FIG. 30 is a sectional view taken along line 30—30 on FIG. 27.

Referring now to FIGS. 22 and 30, the chain conveyor 22 includes a pair of endless chains 134, 135 and three pair of sprocket wheels 136, 137, and 138.

Figure 25:
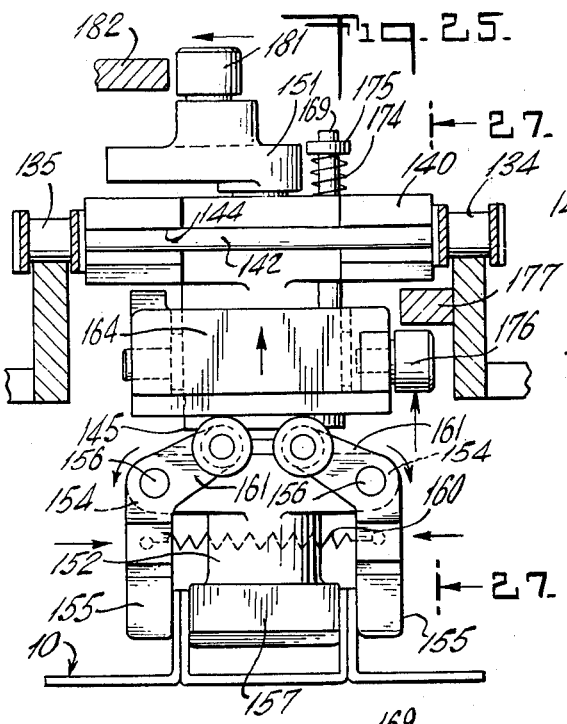
FIG. 25 is a sectional view taken along the line 25—25 on FIG. 22 showing the details of the gripping heads of the chain conveyor.
Figure 27:
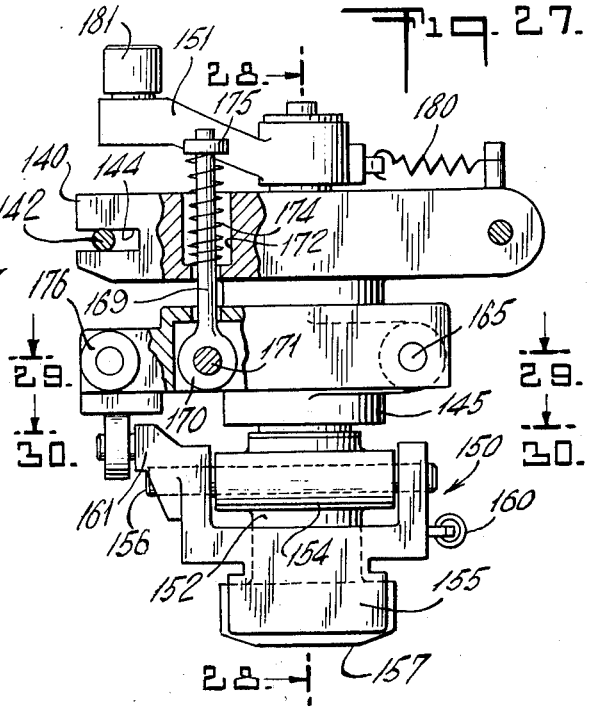
FIG. 27 is a sectional view taken along line 27—27 on FIG. 25.
Figure 26:
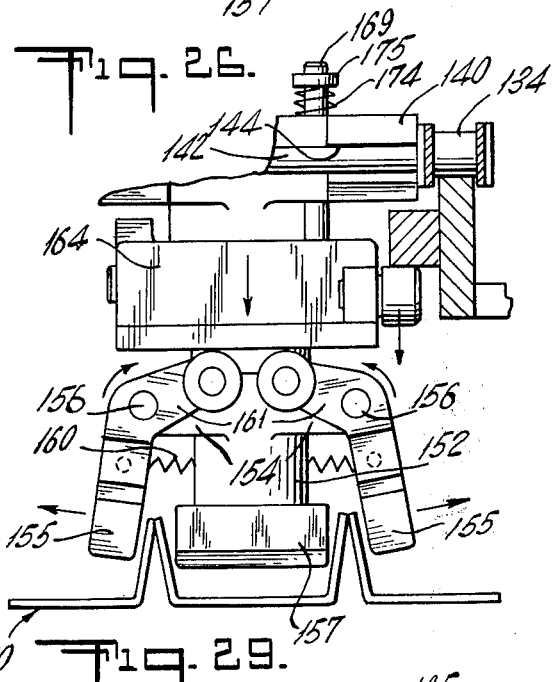
FIG. 26 is a sectional view similar to FIG. 25 taken along line 26—26 on FIG. 22.
Figure 28:
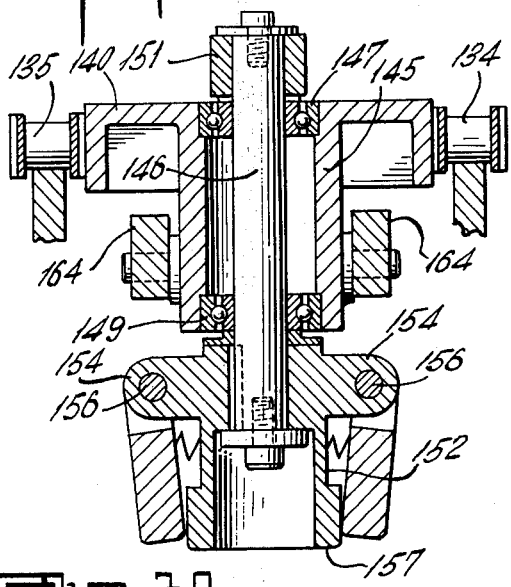
FIG. 28 is a sectional view taken along line 28—28 on FIG. 27.
Figure 29:
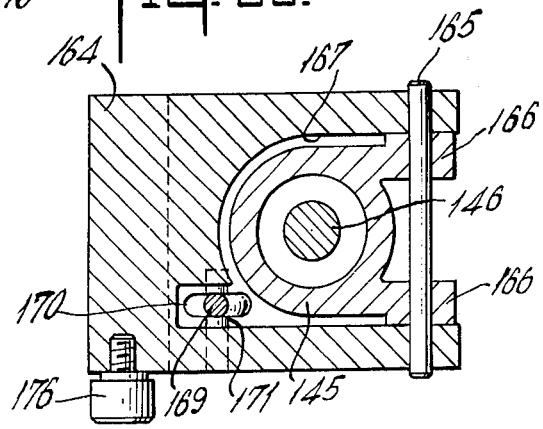
FIG. 29 is a sectional view taken along line 29—29 on FIG. 27.

The gripping heads 26 each include a support member 140 which is positioned between the chains 134 and 135 and is secured thereto by front and rear pins 141 and 142. The rear pin 142 is positioned in a slot 144 to allow the pins to move toward each other as the chains curve in passing around the sprocket wheels. A circular barrel 145 extends perpendicularly from the member 140 and a rod 146 is mounted within the barrel in bearing 147, 149 (FIG. 28). A jaw assembly 150 is mounted on the lower end of the rod 146 and a lever 151 is mounted on the upper end of the rod. The jaw assembly 150 includes a cylindrical body 152 having ears 152 on which jaws 155 are pivotally mounted by means of pins 156. The lower end of the body 152 is formed with a rectangular formation 157 having flat surfaces 159 facing the jaws 155. A spring 160 is connected between the jaws and biases them toward the surfaces 159 to grip the liners 10 as shown in FIG. 25. Each of the jaws is provided with an actuating arm 161 on which is mounted a roller 162. A jaw operating plate 164 is pivotally mounted to the barrel 145 by means of a pin 165. As shown in FIG. 29, the barrel 145 is formed with a pair of ears 166 and the plate is formed with a "U" shaped cut out 167 receiving the barrel 145. The pin 165 extends through the plate 164 and the ears 166. The plate is biased upwardly by a spring assembly including a rod 169 having an eye 170 attached to the plate by a pin 171. The rod 169 extends upwardly through a stepped bore 172 formed in the support member 140. A spring 174 surrounds the rod and acts against the step in the bore 172 and a wonder 175 locked to the end of the rod to lift the plate 164. The spring 174 lifts the plate 164 to allow the spring 160 to pull the jaws 155 toward the formation 157. A cam following roller 176 is mounted on the plate 164 for moving the jaws 155 against the spring 174. A curved cam member 177 is positioned adjacent the sprocket 136 (FIGS. 22 and 26) to engage the roller 176 to pivot the plate 164 against the rollers 162 and rotate the jaws 155 outwardly. Thus, as the heads 26 approach the output end of the folding mechanism, the jaws are spread (as shown in FIG. 26) and then closed again (as shown in FIG. 25) when the roller 176 runs off the end of the cam member 177. A liner 10 is thus gripped, at the leading edge, by each head 26 and carried past the sprocket 137 toward the sprocket 138.

The lever 151 is rigidly secured to the end of the rod 146 and controls the angular orientation of the jaw assembly 150. As shown in FIG. 23 the lever 151 is normally held by a spring 180 in a position which places the jaws parallel to the longitudinal axis of the chain conveyor 22. The lever 151 is provided with a roller 181 which engages a cam element 182 mounted between the sprockets 136 and 138 to rotate the jaw assembly 150 (and the liner carried thereby) as shown in FIG. 24 to align the liner 10 with the conveyor buckets 27. Referring to FIG. 22, when the liner 10 is positioned within the bucket 27, the roller 176 engages a cam element 184 to operate the jaws 155 and release the liner 10. The bucket 27 is provided with a tab 185 to retain the liner therein.

The bucket moves to a loading machine (not shown) where columns of articles, such as cookies or the like, are fed into the upper end of the bucket to rest upon the panels A, D, and G and be separated by the upright walls formed by the panels B & C and the panels E & F. The liner and articles thereon are then placed in a plastic bag P which is closed by a sealing element S as shown in FIG. 2.

It will be seen from the foregoing that the present invention provides apparatus for automatically forming package liners and feeding the formed liners to loading equipment including a constantly moving inclined bucket conveyor.

I claim:

1. Apparatus for forming package liners from flat sheets and depositing the formed liner into inclined buckets of a continuously moving bucket conveyor comprising in combination a magazine for holding the flat sheets, means for creasing said sheets, means for individually removing said sheets from said magazine and feeding them through said creasing means, folding means for folding said sheets along said crease lines including plow elements and upper and lower conveyor belts for gripping the upper and lower surfaces of each sheet to draw the sheet past said plow elements, and overhead conveyor means including a plurality of heads spaced along the length thereof for gripping the formed liners and carrying the liners to the bucket conveyor, said overhead conveyor being arranged at an angle to the bucket conveyor and including means for positioning said heads to align said formed liners with said buckets, said creasing means dividing said sheets into panels and said folding means folding said sheets to form upright walls on either side of a panel, said heads of said overhead conveyor means including a body portion adapted to fit between the upright walls of the formed liner and jaws for clamping the liner walls between the body portion and the jaws.

2. Apparatus according to claim 1 wherein said overhead conveyor means includes an endless chain engaging a first sprocket positioned adjacent the output end of said folding means to bring said head body portion between the walls of the formed line, a second sprocket positioned adjacent the bucket conveyor, cam means adjacent the first sprocket for spreading said jaws as said head body portion moves between the liner walls and for subsequently closing the jaws to grip the liner, and cam means adjacent the bucket conveyor for spreading said jaws to release the liner.

3. Apparatus according to claim 2 including a third sprocket between said first and second sprockets, said third sprocket being positioned to place the chain between the third and second sprocket at a slope comparable to that of the buckets and cam means between said third and second sprockets for rotating said heads to align the liners with the buckets.

* * * * *